US005322022A

United States Patent [19]

Burkholder

[11] Patent Number: 5,322,022

[45] Date of Patent: Jun. 21, 1994

[54] COLLAPSIBLE TABLE

[76] Inventor: Mark W. Burkholder, 1323 Cloverdale, Richardson, Tex. 75080

[21] Appl. No.: 998,620

[22] Filed: Dec. 30, 1992

[51] Int. Cl.[5] ..... A47B 5/00

[52] U.S. Cl. ..... 108/48; 108/132

[58] Field of Search ..... 108/48, 42, 38, 47, 108/123, 130, 131, 132

[56] References Cited

U.S. PATENT DOCUMENTS

| | | | |
|---|---|---|---|
| D. 293,403 | 12/1987 | Umanoff et al. . | |
| D. 305,632 | 1/1990 | Kraklio . | |
| 317,097 | 5/1885 | Danner | 100/132 |
| 1,142,404 | 6/1915 | Deming | 108/48 |
| 1,312,137 | 8/1919 | Schloss | 108/131 |
| 1,827,952 | 10/1931 | Noyes . | |
| 2,240,301 | 4/1941 | Johnson | 108/131 |
| 2,650,145 | 6/1953 | Sieminski | 108/48 |
| 2,673,774 | 3/1954 | Di Prima | 108/38 X |
| 3,315,621 | 4/1967 | Szymber . | |
| 3,628,471 | 12/1971 | Burr | 108/132 |
| 4,051,788 | 10/1977 | Gindele . | |
| 4,155,609 | 5/1979 | Skafte et al. . | |
| 4,318,353 | 3/1982 | Schler | 108/132 |

*Primary Examiner*—Jose V. Chen
*Attorney, Agent, or Firm*—Richards, Medlock & Andrews

[57] ABSTRACT

A collapsible table is provided with one side that is adapted for pivotal attachment to a wall and having two legs extending from the other side that can be readily folded under the table while the table is simultaneously lowered flush against the wall. A locking member is pivotally attached to the underside of the table top that spans between both legs and is rotatable from a first position where it locks both legs vertically underneath the table top, and a second position where the front legs are free to be folded against the underside of the table top. A collapsing line is attached to one front leg, through the midpoint on the locking member, and to the other leg such that when the midsection of the collapsing line is pulled, it pulls the front legs up underneath the table top which allows the table top to be simultaneously lowered to its collapsed position flush with the wall.

11 Claims, 2 Drawing Sheets

COLLAPSIBLE TABLE

TECHNICAL FIELD OF THE INVENTION

The present invention relates to a table that is adapted to be rotatably attached to a wall on one side and that has readily collapsible legs on the opposite side such that the table can be readily collapsed and rotated down flush against the wall.

BACKGROUND OF THE INVENTION

Often, available work space in a person's garage or home is very limited. Thus, many people cannot have a permanent work table, but rather must utilize various types of collapsible tables that can be stowed away when the table is not in use. However, stand alone collapsible tables are often cumbersome and time consuming to set up and stow away. Thus, a need exists for a work table that is adapted for attachment to a relatively permanent structure, such as an existing wall, and that is also readily collapsible such that the work table can be folded down flush with the existing wall to occupy minimal space in its collapsed position. A need further exists for such a collapsible table that can be collapsed and erected in one easy continuous motion instead of a series of time consuming and cumbersome maneuvers. Additionally, a need exists for such a table that has a safety mechanism to prevent inadvertent collapsing of the work table.

SUMMARY OF THE INVENTION

The present invention provides a collapsible work table that is adapted for attachment to a permanent structure, such as an existing wall or support pieces attached to a wall, and that is readily collapsible flush with the permanent structure and out of the way in one easy continuous motion. Additionally, the table of the present invention is easily erected in one continuous motion. The collapsible work table of the present invention is adapted for attachment to a wall, or other relatively permanent structure, and comprises a table top of a generally planar configuration with one edge hinged to the wall. Alternatively, the table top can be hinged to support members which are adapted to be fixed to the wall. The table top is rotatable about the hinges between an erected position where the table top is extending perpendicular from the wall and a second position where the table top is hanging vertical from the hinges.

A first leg is pivotally mounted to the underside of the table at one front corner. The first leg is rotatable from an extended first position where the first leg extends vertically from the underside of the table top for supporting the table top in its erected position and a folded position where the first leg is flush with the underside of the table top. A second leg is pivotally mounted to the underside of the table top at the second front corner and is likewise rotatable between an extended position where it extends vertically from the underside of the table top for supporting the table top in its erected position and a folded position where the second leg is flush with the underside of the table top.

The collapsible table also comprises a locking member pivotally attached to the underside of the table top and extending from the first leg to the second leg. The locking member is rotatable between a locking position where the locking member extends vertically from the underside of the table top and locks the first and second legs vertically underneath the table top, and an unlocked position where the locking member is flush with the underside of the table top and unlocked from the first and second legs such that the first and second legs are free to be rotated to their folded position. The locking member is readily graspable by one hand to be rotated between its locked and unlocked position. The locking member further has a guide passage, for example two holes, located generally in the middle of the locking member.

A collapsing line is run through the two holes in the locking member and has a first end attached to the first leg and a second end attached to the second leg. The collapsing line is of a length such that when the table top is erected and the first and second legs are extended, the collapsing line can be grasped at its midsection between the two holes. When the locking member is rotated to its unlocked position, pulling the midsection of the collapsing line away from the free edge of the table top pulls the first and second legs towards their folded positions which allows the table top to be simultaneously lowered toward its collapsed position.

A further embodiment of the present invention further comprises a catch extending from the underside of the table top in front of the locking member. The catch is pivotable only in a direction perpendicular to the direction in which the locking member pivots. Therefore, the catch will prevent inadvertent rotation of the locking member out of its locked position until the catch is rotated out of interference with the rotation of the locking member.

DETAILED DESCRIPTION

Figure 1:
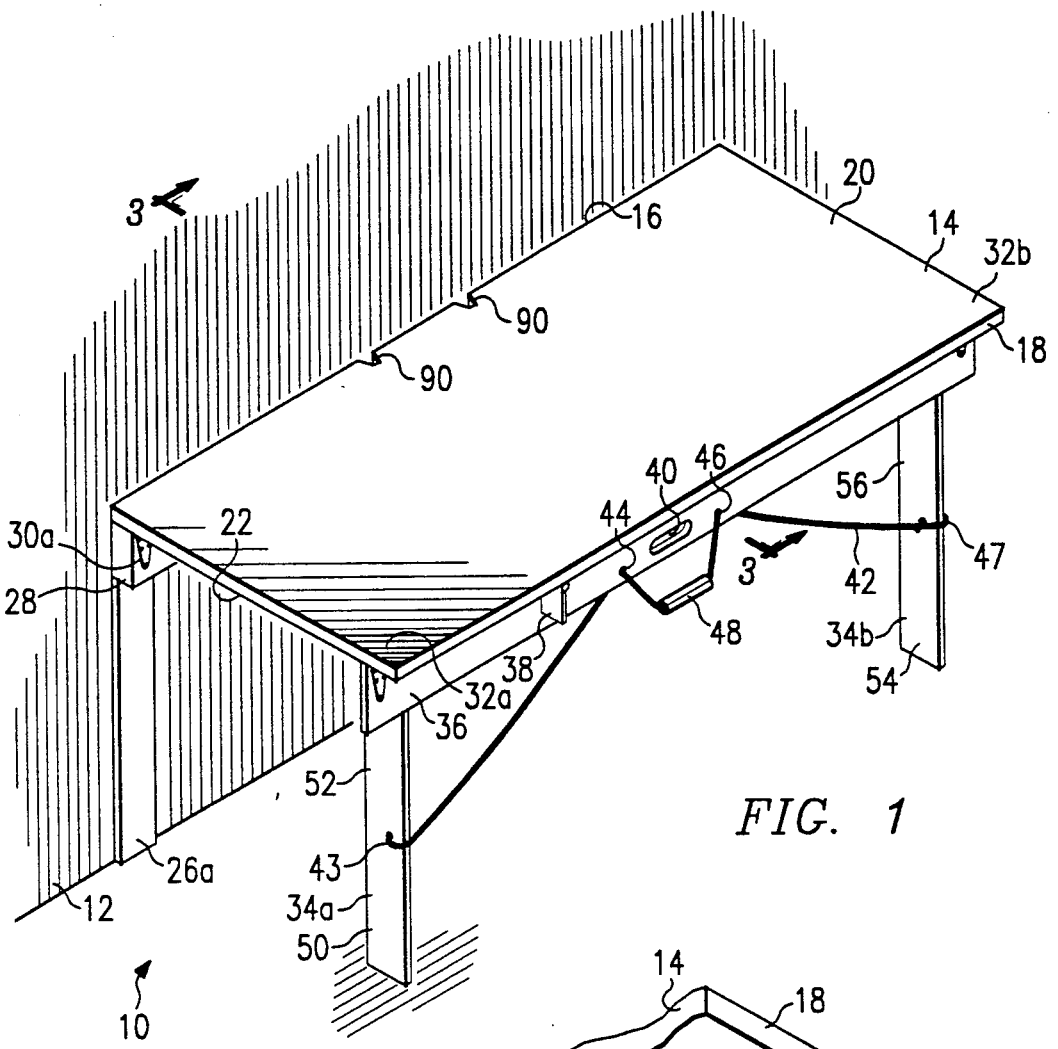
FIG. 1 is a perspective view of the collapsible table of the present invention in its erected position.

With reference to FIG. 1, the preferred embodiment of the collapsible table 10 of the present invention is shown extending from wall 12 in the erected position. Collapsible table 10 comprises table top 14 of a generally planar configuration with fixed edge 16 along wall 12 and free edge 18 opposite thereto. Table top 14 has top surface 20 and underside 22. Fixed edge 16 of table top 14 is supported on horizontal support member 28 which is attached to vertical support members 26*a* and 26*b*. Table top 14 is pivotally attached at its fixed edge 16 to horizontal support member 28 by hinges 30*a* and 30*b* such that table top 14 can pivot downwardly until it is generally flush with wall 12.

Two foldable legs 34a and 34b extend from underside 22 at first corner 32a and second corner 32b, respectively, of table top 14.

Locking member 36 pivotally extends from underside 22 and interlocks with foldable legs 34a and 34b. Safety catch 38 pivotally extends from underside 22 proximal locking member 36 so as to prevent unintended pivoting of locking member out of locking engagement with legs 34a and 34b. Opening 40 in locking member 36 allows for grasping of locking member 36. Collapsing line 42 is attached to leg 34a at its first end 43, extends through at least one guide passage shown as holes 44 and 46 in locking member 36 and is attached at its second end 47 to leg 34b. Handle 48 is positioned on collapsing line 42 between holes 44 and 46. When locking member 36 is disengaged from legs 34a and 34b, pulling handle 48 away from free edge 18 will pull first end 43 and second end 47 of collapsing line 42 inwardly causing legs 34a and 34b to pivot inwardly and fold upwardly against underside 22 of table top 14.

Table top 14 is rotatable about hinges 30a and 30b between an erected position where table top 14 is extending perpendicular from wall 12, and a collapsed position where table top 14 is hanging vertically from hinges 30a and 30b. First leg 34a has free end 50 and fixed end 52. Fixed end 52 is pivotally mounted to underside 22 of table top 14 proximate first corner 32a such that first leg 34a is rotatable between an extended position where first leg 34a extends vertically from underside 22 of table top 14 for supporting table top 14 in the erected position, and a folded position where first leg 34a is folded against underside 22 of table top 14. Second leg 34b has free end 54 and fixed end 56. Fixed end 56 is pivotally mounted to underside 22 of table top 14 proximate second corner 32b such that second leg 34b is rotatable between an extended position where second leg 34b extends vertically from underside 22 of table top 14 for supporting table top 14 in the erected position, and a folded position where second leg 34b is folded against underside 22 of table top 14.

Locking member 36 is pivotally attached to underside 22 of table top 14 and spans horizontally at least the distance between fixed ends 52 and 56 of first and second legs 34a and 34b, respectively. Locking member 36 is rotatable from a locked position where locking member 36 extends vertically from underside 22 of table top 14 and interlocks with fixed ends 52 and 56 of first and second legs 34a and 34b, respectively, to lock first and second legs 34a and 34b in their extended positions, and an unlocked position where locking member 36 is flush with underside 22 of table top 14 and unlocked from first and second legs 34a and 34b such that first and second legs 34a and 34b are free to be rotated to their folded positions. Locking member 36 is readily graspable by one hand to be rotated between its locked and unlocked positions. Locking member 36 further has at least one guide passage shown as holes 44 and 46 located generally at the middle of locking member 36.

Collapsing line 42 runs through holes 44 and 46 in locking member 36 and has first end 43 attached to first leg 34a appreciably away from fixed end 52 of first leg 34a, and second end 47 attached to second leg 34b appreciably away from fixed end 56 of second leg 34b. Collapsible line 42 is of a length such that when first and second legs 34a and 34b are in their extended positions, collapsing line 42 can be grasped at its midsection between holes 44 and 46.

When locking member 36 is rotated to its unlocked position, pulling the midsection of collapsing line 42 away from free edge 18 of table top 14 pulls first and second ends 43 and 47, respectively, of collapsing line 42 towards holes 44 and 46 which rotates first and second legs 34a and 34b towards their folded positions which allows table top 14 to be simultaneously lowered toward its collapsed position.

Figure 2:
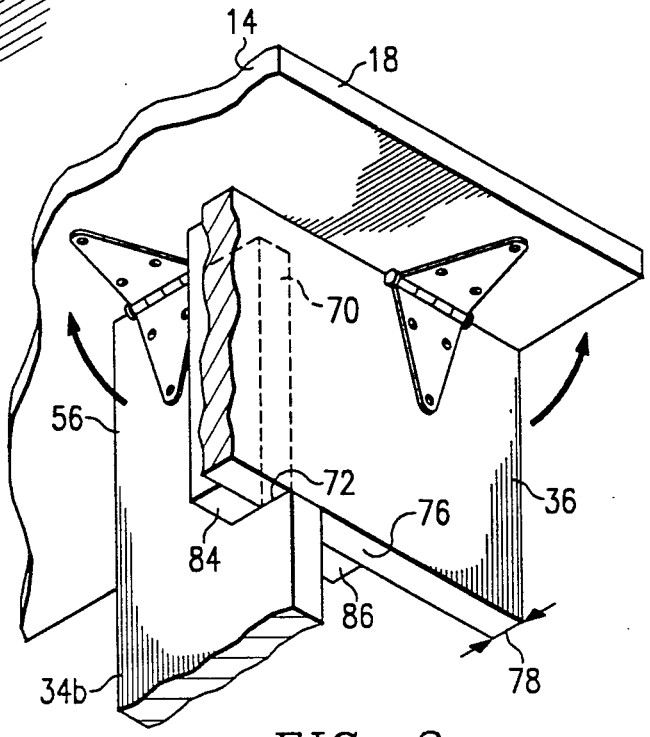
FIG. 2 is a detailed perspective view of the interengagement between the locking member and a leg of the collapsible table of the present invention.
Figure 3:
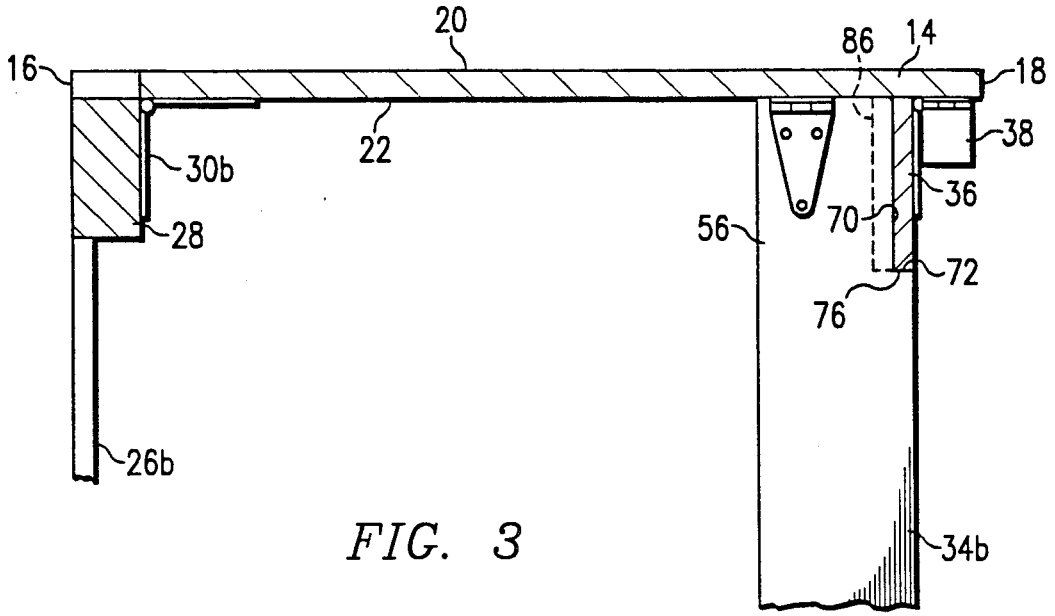
FIG. 3 is a partial cross-section of the collapsible table of the present invention taken along line 3—3 in FIG. 1.

With reference to FIGS. 2 and 3, the structure of the locking engagement between locking member 36 and leg 34b is shown in detail. Fixed end 56 of second leg 34b is shown in FIG. 2 with cut out 70 facing towards free edge 18 of table top 14. Cut out 70 defines a shoulder 72. Locking member 36 has bottom surface 76 of width 7 such that bottom surface 76 seats on shoulder 72 of second leg 34b when locking member 36 is in the locked position. The seating of bottom surface 76 on shoulder 72 prevents leg 34b from rotating.

The preferred embodiment of FIG. 2 further comprises protrusions 84 and 86 which are shown as blocks attached to the back side of locking member 36 which provide further rotational locking of second leg 34b by extending along side each side of second leg 34b. Protrusions 84 and 86 provide an extra safety measure in that if locking member 36 is partially rotated such that bottom surface 76 is not seated on shoulder 72, protrusions 84 and 86 can still provide a rotational locking of second leg 34b by virtue of their extending out sufficiently to interfere with any rotation of second leg 34b. On the other hand, if protrusions 84 and 86 were not present, and locking member 36 was rotated such that bottom surface 76 was beyond shoulder 72, second leg 34b could possibly be free to prematurely rotate and cause the inadvertent collapsing of table top 14. The interlocking between locking member 36 and first leg 34a is identical to the interlocking just described between locking member 36 and second leg 34b.

It should be appreciated that protrusions 84 and 86 and locking member 36 could alternatively be one piece, for example, a molded plastic piece or a vertical notch running along the back side of the locking member 36 such that the sides of the vertical notch enveloping the vertical part of cut-out 70 above shoulder 72 constitute the protrusions 84 and 86.

Figure 4A:
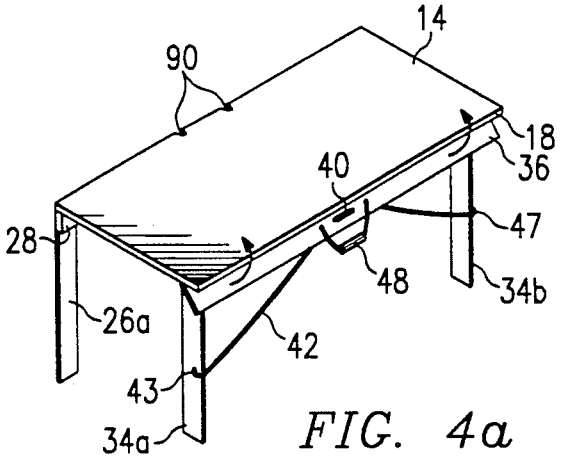
FIG. 4*a* is a perspective view of the collapsible table of the present invention with its locking member being rotated out of its locked position with the front legs.
Figure 4B:
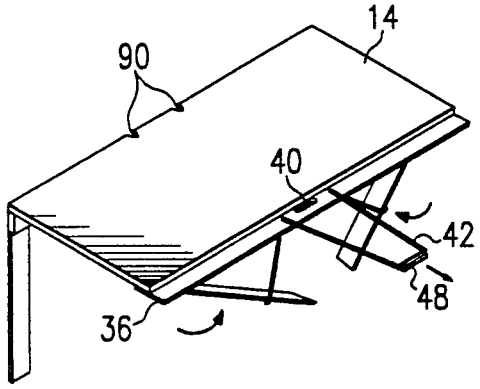
FIG. 4*b* is a perspective view of the collapsible table of the present invention with the locking member in its unlocked position and the front legs being rotated towards their folded positions by the pulling of the midsection of the collapsing line.
Figure 4C:
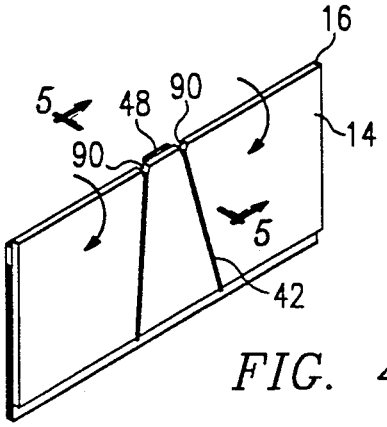
FIG. 4*c* is a perspective view of the collapsible table of the present invention shown in the collapsed position.

FIGS. 4a–4c illustrate how the collapsible table is quickly and easily collapsed to fold down against the wall. In FIG. 4a, locking member 36 is rotated out of its locked position. The locking member can be grabbed anywhere to impart rotation, but opening 40 is provided to allow better grasping of the locking member. In FIG. 4b, handle 48 at the midsection of collapsing line 42 is being pulled away from table top 14 and causing legs 34a and 34b to fold up underneath table top 14. At this stage table top 14 remains horizontal because holding locking member 36 at opening 40, holds table top 14. As legs 34a and 34b begin to fold up, table top 14 can be lowered towards the wall 12. FIG. 4c shows table top 14 completely lowered and against wall 12. Legs 34a and 34b are completely folded between table top 14 and wall 12.

Figure 5:
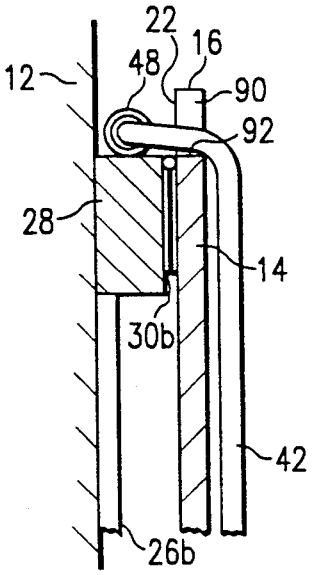
FIG. 5 is a partial cross-section taken along line 5—5 in FIG. 4*c*.

With reference to FIG. 4c and FIG. 5, collapsing line 42 is of such a length that handle 48 can be handily placed behind fixed edge 16 on horizontal support member 28. Additionally, table top 14 has notches 90 in which collapsing line 42 can be placed such that if collapsing line 42 is inadvertently tugged, such as being brushed by a person's leg as they pass by, it can be seen that handle 48 is prevented from being pulled over edge 16 because it will be pulled directly against underside 22 of table top 14 by virtue of collapsing line 42 being in notches 90. On the other hand, if notches 90 were not present and line 42 was inadvertently tugged, it can be envisioned that collapsing line 42 could pull handle 48 up and over edge 16. Thus, notches 90 serve to prevent accidental removal of handle 48 from on top of support member 28 where it is handily stowed until the table is to be erected.

To erect the table, the process is simply reversed. Initial raising of table top 14 can be accomplished by pulling up handle 48 until opening 40 or locking member 36 can easily be reached. Once table top is being held by one hand, the other hand can begin lowering handle 48 which permits legs 34*a* and 34*b* to extend downwardly under their own weight. When the legs are completely extended between the table and the ground, locking member 36 can be rotated into locking position.

While some embodiments of the present invention have been illustrated in the accompanying drawings and described in the foregoing Detailed Description, it will be understood that the invention is not limited to the embodiments disclosed, but is capable of numerous rearrangements, modifications and substitutions of parts and elements without departing from the spirit of the invention as hereinafter claimed.

I claim:

1. A collapsible table adapted for attachment to a wall, comprising:

(a) a table top of a generally planar configuration having an underside, a top surface, a fixed edge, and a free edge opposite the fixed edge having a first corner and a second corner, at least one hinge attached to said fixed edge such that the table top can be mounted to the wall at the at least one hinge so as to be rotatable between an erected position where the table top is extending perpendicular from the wall, and a collapsed position where the table top is hanging vertical from the at least one hinge;

(b) a first leg having a free end and a fixed end, the fixed end pivotally mounted to the underside of the table top proximate the first corner such that the first leg is rotatable between an extended position where the first leg extends vertically from the underside of the table top for supporting the table top in the erected position, and a folded position where the first leg is folded against the underside of the table top;

(c) a second leg having a free end and a fixed end, the fixed end pivotally mounted to the underside of the table top proximate the second corner such that the second leg is rotatable between an extended position where the second leg extends vertically from the underside of the table top for supporting the table top in the erected position, and a folded position where the second leg is folded against the underside of the table top;

(d) a longitudinal locking member pivotally attached along its top edge to the under side of the table top and spanning horizontally between the fixed ends of the first and second legs, the locking member being rotatable from a locking position where the locking member extends vertically from the underside of the table top and interlocks with the fixed ends of the first and second legs to lock the first and second legs in their extended positions, and an unlocked position where the locking member is flush with the underside of the table top and unlocked from the first and second legs such that the first and second legs are free to be moved to their folded positions, the locking member having at least one guide passage located generally at the middle of the locking member;

(e) a collapsing line passing through the at least one guide passage in the locking member and having a first end attached to a mid point along the first leg and a second end attached at a mid point along the second leg.

2. The collapsible table of claim 1 wherein the at least one guide passage is two holes in the locking member spaced apart such that the length of collapsing line spanning between the two holes when the first and second legs are in their extended positions allows the collapsing line to be readily grasped.

3. The collapsible table of claim 2 further comprising a handle attached to the collapsing line at its midsection, said collapsing line oriented through the two holes such that the handle is on the side of the locking member towards the free edge of the table top.

4. The collapsible table of claim 3 wherein the collapsing line is of such a length that when the table top is in its collapsed position, the handle can be placed behind the fixed edge of the table top.

5. The collapsible table of claim 4 wherein the fixed edge of the table top has two notches therein and spaced apart such that when the table top is in its collapsed position and the handle is placed behind the fixed edge, the collapsing line extending from each end of the handle can be readily placed in the notches.

6. The collapsible table of claim 4 wherein the first and second ends of the collapsing line are attached at generally the middle of the first and second legs, respectively.

7. The collapsible table of claim 1 further comprising support members to which the at least one hinge are attached, the support members adapted to be secured to the wall, the fixed edge of the table top being hinged to the support members such that the table top is partially supported on the support members.

8. The collapsible table of claim 1 further comprising a safety catch extending from the underside of the table top proximate the locking member and pivotable, only in a direction perpendicular to the direction in which the locking member pivots, between a safety position where the safety catch extends alongside the locking member in its locked position so as to prevent inadvertent rotation of the locking member out of its locked position, and a free position where the safety catch is flush with the underside of the table top so as to allow the locking member to be rotated out of its locked position.

9. The collapsible table of claim 1 wherein the fixed ends of the first and second legs each have a shoulder towards the front edge of the table top, and the locking member extends from the underside along a line that is generally above the shoulders, the locking member having a top which is hinged to the underside and a bottom surface such that when the locking member is in the locked position, the bottom surface seats on the shoulders so as to prevent rotation of the first and second legs.

10. The collapsible table of claim 9 further comprising a block placed on each side of each notch on the back side of the locking member, the blocks sized such that they extend on each side of the first and second legs to contribute to the prevention of rotation of the first and second legs.

11. The collapsible table of claim 1 wherein the first and second legs are pivotally attached to the underside and of a weight such that the first and second legs will unfold away from the underside of the table top when the table top is rotated away from the wall and the collapsing line is unrestrained.

* * * * *